US005937686A

United States Patent [19]

Arai

[11] Patent Number: 5,937,686

[45] Date of Patent: Aug. 17, 1999

[54] BENDING APPARATUS FOR HOLLOW DOUBLE-STRUCTURED PIPE

[75] Inventor: Saburo Arai, Urawa, Japan

[73] Assignees: Sankei Giken Kogyo Kabushiki Kaisya, Tokyo; Kabushiki Kaisya Vista, Saitama, both of Japan

[21] Appl. No.: 08/919,277

[22] Filed: Aug. 28, 1997

[30] Foreign Application Priority Data

Aug. 29, 1996 [JP] Japan ..... 8-247175

[51] Int. Cl.[6] ..... B21D 9/05; B21B 17/02

[52] U.S. Cl. ..... 72/150; 72/369; 72/370.01

[58] Field of Search ..... 72/150, 369, 367.1, 72/370.01, 466, 465.1, 398, 466.2

[56] References Cited

U.S. PATENT DOCUMENTS

| | | | |
|---|---|---|---|
| 2,998,836 | 9/1961 | Hitz | 72/150 |
| 4,481,803 | 11/1984 | Dieser | 72/150 |
| 5,214,950 | 6/1993 | Grobbenhaar | 72/150 |

FOREIGN PATENT DOCUMENTS 55-24971 7/1980 Japan .

*Primary Examiner*—Joseph J. Hail, III
*Assistant Examiner*—Rodney Butler
*Attorney, Agent, or Firm*—Armstrong, Westerman Hattori, McLeland & Naughton

[57] ABSTRACT

This invention is concerned with an apparatus for bending a hollow double-structured pipe for use in an exhaust pipe of an internal combustion engine, for example, and aims at providing such hollow double-structured pipe which is capable of effecting favorable bending work, even in the case of using an inner pipe of a thin wall thickness. The hollow double-structured pipe bending apparatus according to the present invention is of such construction that, in a hollow double-structured pipe bending apparatus, wherein an inner core metal 5 is inserted into an inner pipe 11 of the hollow double-structured pipe 10, while a tubular core metal 6 is interposed in a space gap between the inner pipe 11 and the outer pipe 12, and these core metals 5, 6 are positioned in the vicinity of the starting position for the bending work, followed by subjecting the hollow double-structured pipe 10 to the bending work by means of a bending dies 1, the apparatus being characterized in that one end part of the abovementioned tubular core metal 6 is made to protrude forwardly, in the bending direction, of the abovementioned starting position for bending, and, at the same time, a chamfered part 61, 62 is formed on the protruded part, in a substantially same shape as the final bent shape of the abovementioned inner pipe 11 and outer pipe 12.

6 Claims, 6 Drawing Sheets

BENDING APPARATUS FOR HOLLOW DOUBLE-STRUCTURED PIPE

BACKGROUND OF THE INVENTION a) Field of the Invention

This invention relates to the so-called "hollow double-structured pipe bending apparatus", in which a double-structured pipe for use in an exhaust pipe of an internal combustion engine of, for example, an automobile, and so forth is positioned substantially concentrically with a predetermined space gap being kept between an inner pipe and an outer pipe.

b) Description of Prior Arts

Various proposals have heretofore been made for such hollow double-structured pipe bending apparatus. As an example, there have been known those apparatuses for bending the double-structured pipe in a predetermined shape with a predetermined space gap being maintained between the inner pipe and the outer pipe, wherein, for example, an inner core metal is inserted into the inner pipe and a tubular core metal is interposed in a space between the inner pipe and the outer pipe, and one end of each of the inner pipe and the outer pipe is fitted and held on a bending dies, followed by rotating the die to bend both inner pipe and outer pipe simultaneously along the shaping face of the bending die (vide, for example, Japanese Patent Publication No. 55-24971).

With the conventional pipe bending apparatus, however, such hollow double-structured pipe could not necessarily be bent as desired, with the consequence that there have often accrued various inconveniences such that creases, etc. often took place on the inner peripheral side of the pipe in its bending direction (above all, on the inner peripheral side of the inner pipe), or the pipe itself was subjected to buckling, and others. In particular, with the exhaust pipe for those advanced modern internal combustion engines, demand has been raised in making the wall thickness of the inner pipe to be the thinnest possible for improving its cleaning efficiency of exhaust gas, or for attaining its light-weight. However, such light-weight pipe with its thin wall thickness tends to readily bring about the abovementioned creases and buckling.

The present invention is proposed in view of the abovementioned points of problem inherent in the conventional pipe bending apparatus, and aims at providing an improved hollow double-structured pipe bending apparatus which is capable of effecting good bending work on a double-structured pipe, even when an inner pipe of a thin wall thickness is used.

SUMMARY OF THE INVENTION

It is therefore a primary object of the present invention to provide a bending apparatus for a hollow double-structured pipe with a novel construction and high working efficiency.

With a view to attaining the abovementioned objective, the hollow double-structured pipe bending apparatus according to the present invention is constructed in the following manner.

That is to say, according to the present invention, in its general aspect, there is provided an apparatus for bending hollow double-structured pipe, in which an inner core metal is inserted into an inner pipe of the hollow double-structured pipe, while a tubular core metal is interposed in an space gap between the inner pipe and the outer pipe, and these core metals are positioned in the vicinity of the starting position for the pipe bending work, the bending apparatus being characterized in that one end part of the abovementioned tubular core metal is made to protrude forwardly of the bending direction with respect to the abovementioned starting position for bending, and a chamfered part is formed on the protruded part, in a substantially same shape as the final bent shape of the abovementioned inner and outer pipes.

The foregoing objective, other objectives as well as the specific details of the present invention will become more apparent and understandable from the following description thereof, when read in conjunction with the accompanying drawing.

BRIEF DESCRIPTION OF THE ACCOMPANYING DRAWING

Figure 6A:
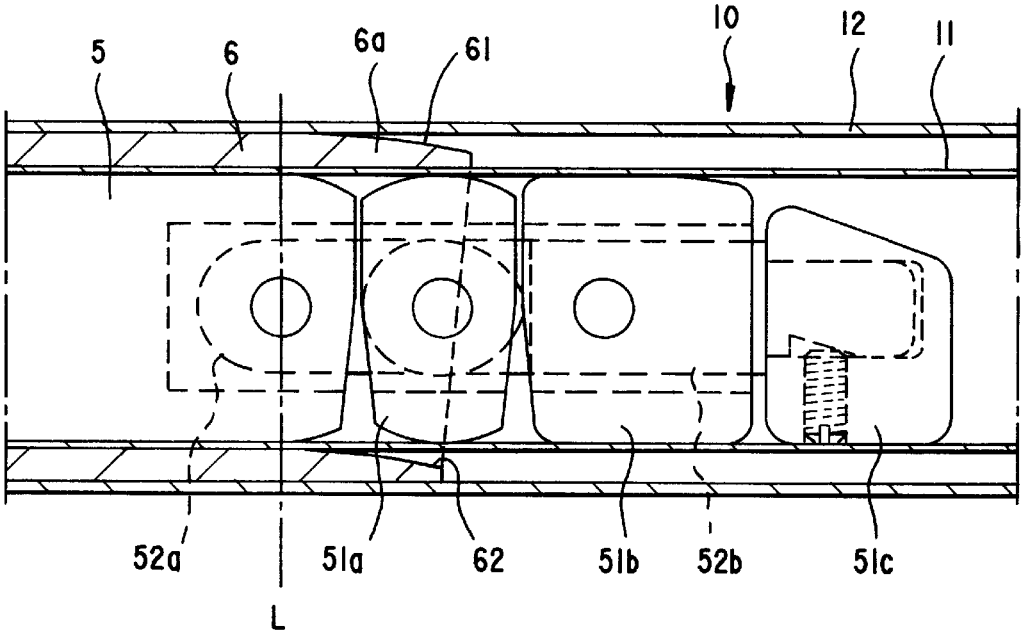
Figure 6B:
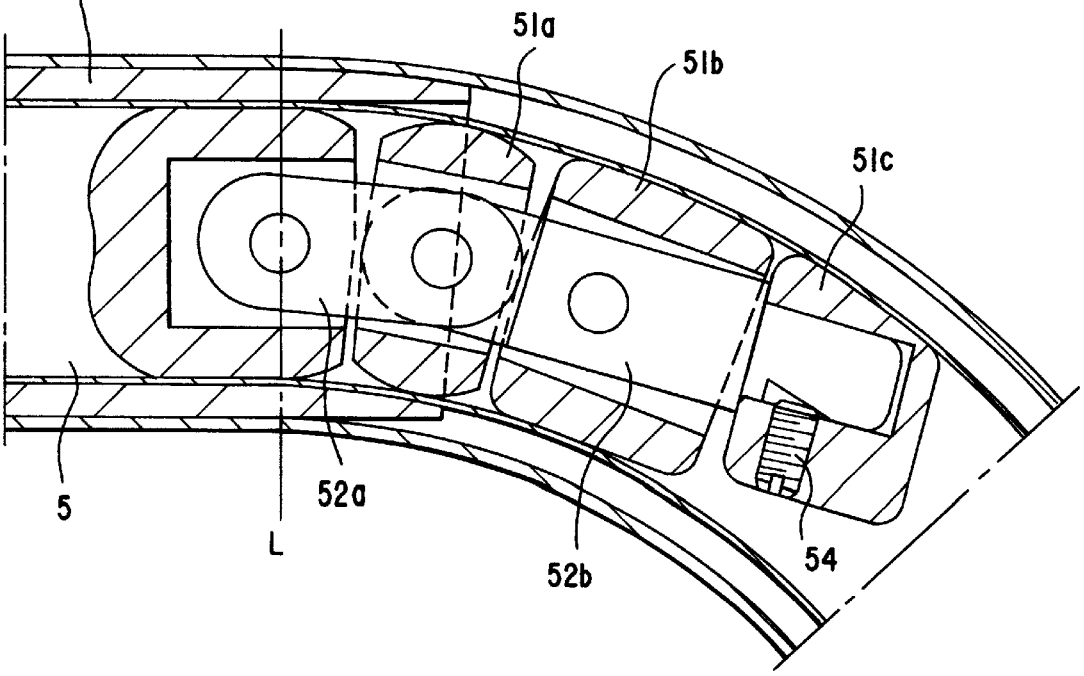

FIG. 6(A) is a front view, in an enlarged longitudinal cross-section, showing the main part of the pipe bending apparatus according to the present invention, in which use is made of a modified embodiment of the tubular core metal; and FIG. 6(B) is also a front view, in an enlarged longitudinal cross-section, showing the main part of the pipe bending apparatus according to the present invention, in its state of bending work.

DETAILED DESCRIPTION OF PREFERRED EMBODIMENT

In the following, the hollow double-structured pipe bending apparatus according to the present invention will be explained more specifically in reference to preferred embodiments shown in the accompanying drawing.

Figure 1A:
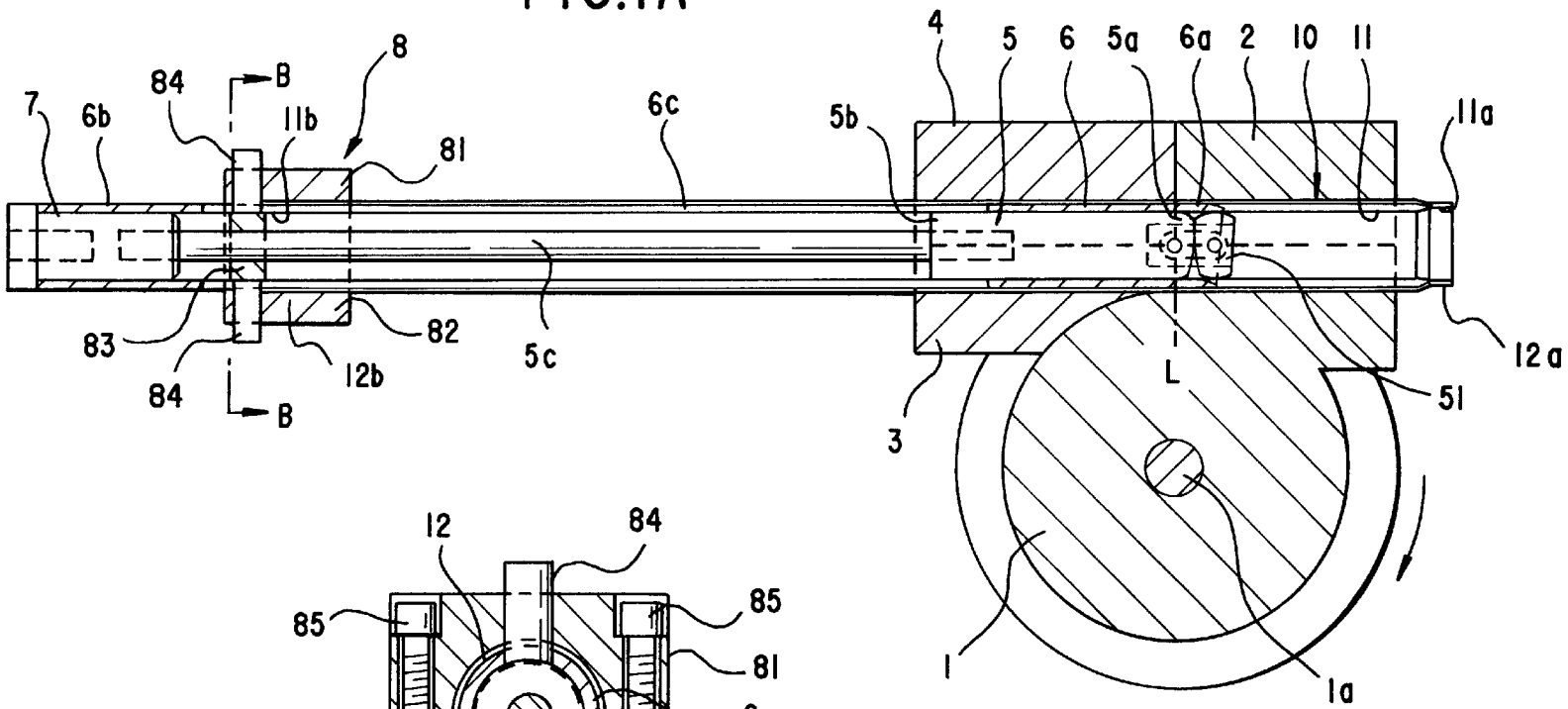
FIG. 1(A) is a front view, partly in longitudinal cross-section, showing one mode of embodiment of the pipe bending apparatus according to the present invention.
Figure 1B:
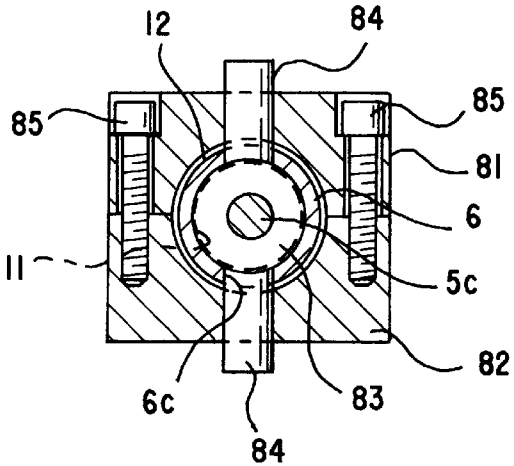
FIG. 1(B) is a cross-sectional view, taken along the line B—B in FIG. 1(A)
Figure 2:
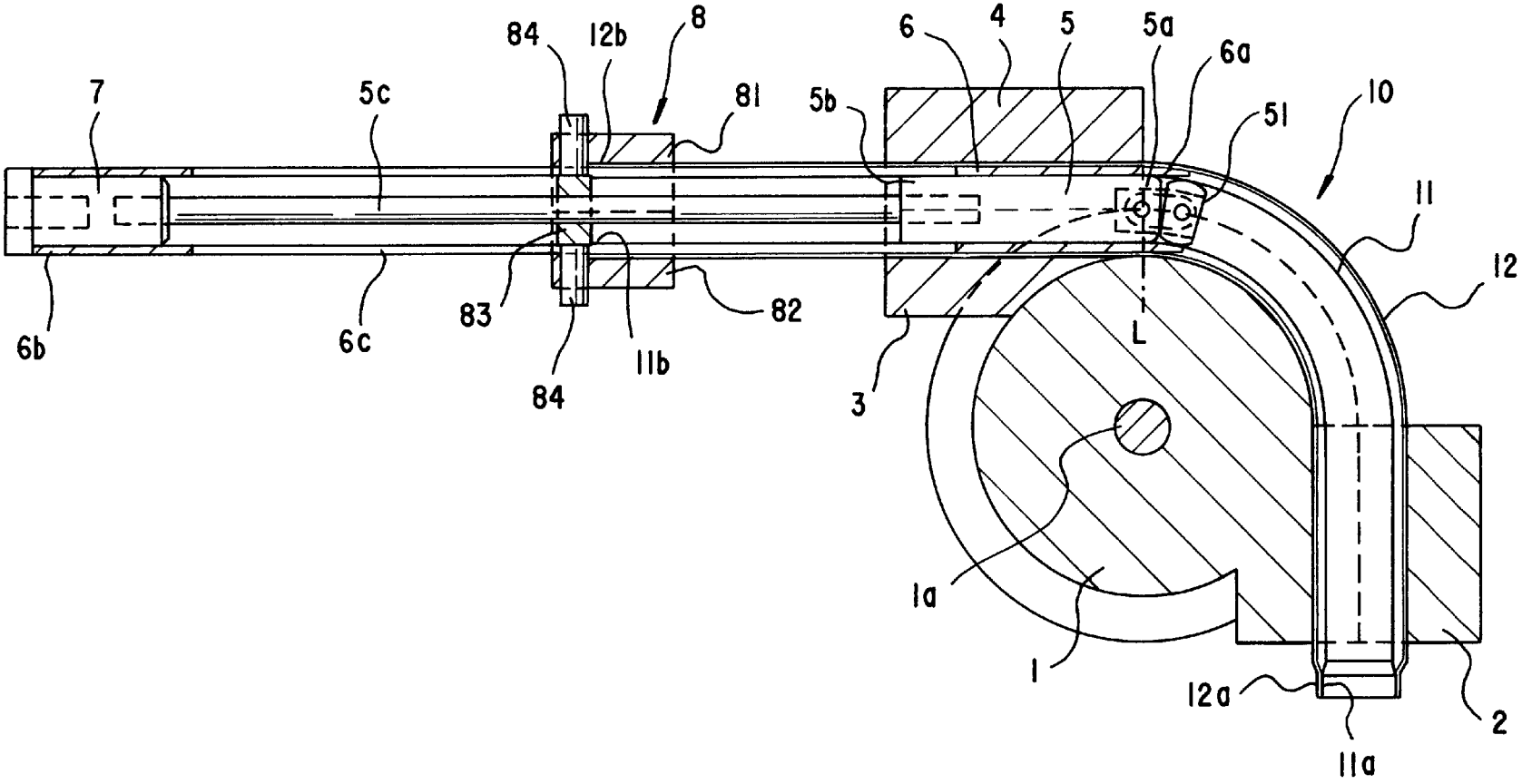
FIG. 2 is a front view, partly in longitudinal cross-section, showing a state of bending work by means of the pipe bending apparatus according to the present invention.
Figure 3A:
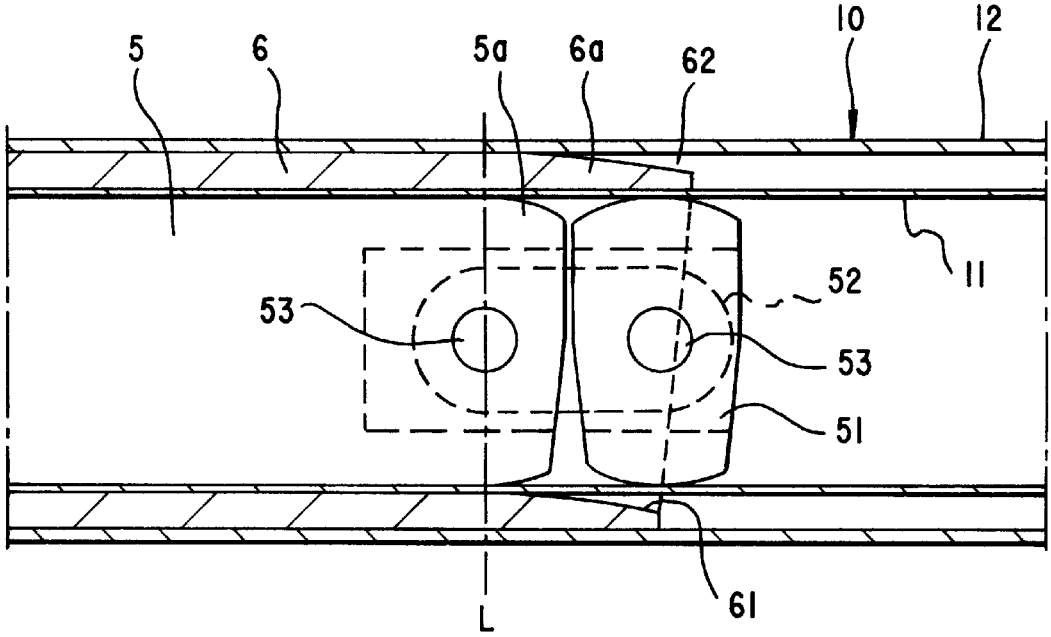
FIG. 3(A) is a front view, in an enlarged longitudinal cross-section, of a part of the pipe bending apparatus according to the present invention.
Figure 3B:
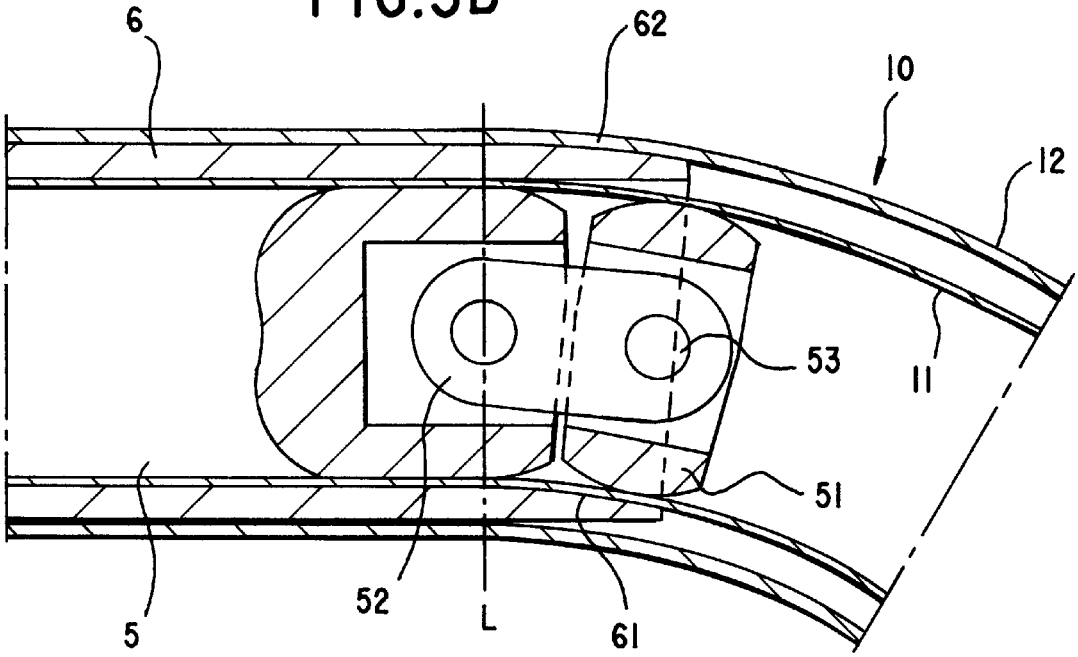
FIG. 3(B) is also a front view, in an enlarged longitudinal cross-section, of a part of the pipe bending apparatus according to the present invention, in its state of bending work.

FIGS. 1(A) and 1(B) illustrate one embodiment of the pipe bending apparatus according to the present invention, in which FIG. 1(A) is a front view, partly in longitudinal cross-section of the pipe bending apparatus according to the present invention, and FIG. 1(B) is a cross-sectional view, taken along the line B—B in FIG. 1(A). FIG. 2 is a front view, partly in longitudinal cross-section, of the pipe bending apparatus according to the present invention, showing a state of its bending work. FIGS. 3(A) and 3(B) are the enlarged longitudinal cross-sectional views of the main part of the pipe bending apparatus according to the present invention.

Referring now to these figures of drawing, a reference numeral 1 designates a bending die rotatably mounted around an axis 1*a;* a reference numeral 2 denotes a die for fixing a work piece to the bending die 1, a numeral 10 refers to a hollow double-structured pipe held and fixed between the fixing die 2 and the bending die 1. In the vicinity of the bending die 1, there is fixedly disposed a shoe 3 in a manner to be in contact with the bending die 1. Between the shoe 3 and a pressing die 4, there is slidably held the hollow double-structured pipe 10.

The hollow double-structured pipe 10 is constructed with an inner pipe 11 and an outer pipe 12. One end parts 11*a*, 12*a* of the inner and outer pipes 11, 12 (i.e., the right end as viewed in FIG. 1(A), hereinafter referred to as "front end") are brought into close contact with each other around their mutually opposed peripheral surfaces in the inner and the outer directions, and integrally fastened together by welding, etc., the other ends (i.e., the left end as viewed in FIG. 1(A), hereinafter referred to as "rear end") being left open. Within the inner pipe 11 of the hollow double-structured pipe 10, there is inserted an inner core metal 5, and, between the inner pipe 11 and the outer pipe 12, there is interposed a tubular core metal 6, both core metals being inserted from the rear open end side of the inner and outer pipes 11, 12.

The rear end part 6*b* of the tubular core metal 6 is fixedly connected to a fixed holding member 7, while the rear end part 5*b* of the inner core metal 5 is fixedly connected to the abovementioned fixed holding member 7 through a connecting rod 5*c*, In this manner, the front end parts 5*a*, 6*a* of the inner core metal 5 and the tubular core metal 6, respectively, are constantly positioned in the vicinity of the starting position L for bending the pipe by means of the abovementioned bending die 1.

Thus, the present invention is so constructed that one end part (front end part) 6*a* of the abovementioned tubular core metal 6 is made to protrude forwardly of the abovementioned starting position L for bending, in its bending direction, simultaneously with formation, at this protruded part, of a chamfered part 61, 62 in a substantially same shape as the final bent shape of the inner and outer pipes. In the case as shown in FIG. 3, the chamfered part 61 is formed on the inner peripheral surface of the inside of the inner and outer pipes 11, 12 in their bending direction at the protruded front end part of the tubular core metal 6, and the chamfered part 62 is formed on the outer peripheral surface of the outside of the pipes in their bending direction, whereby the chamfered part 61 on the inner peripheral surface side is shaped in a curved surface substantially identical with the final bent shape of the inner pipe 11, while the chamfered part 62 on the outer peripheral surface side is shaped in a curved surface substantially identical with the final bent shape of the outer pipe 12.

In the illustrated embodiment, the forward end 5*a* of the inner core metal 5 is also protruded forwardly of the abovementioned starting position L for bending, the projected part being formed in a spherical shape. Moreover, an auxiliary core metal 51 is provided on the front end part 5*a* of the inner core metal 5. In the illustrated embodiment, this auxiliary core metal 51 is connected to, and held on, the extreme end part of the inner core metal 5 through a connecting member 52 and a connecting rod 53, the peripheral surface of this auxiliary core metal 51 being formed in a spherical shape.

In FIG. 1, a reference numeral 8 designates a forwarding member for sending out the inner pipe 11 and the outer pipe 12 simultaneously to the side of the abovementioned die 1, when the hollow double-structured pipe 10 is subjected to the bending work by means of the bending die 1, the forwarding member being provided depending on necessity. In the illustrated case, the forwarding member 8 is constructed with a pair of split fixing members 81, 82 to be fitted and held on the outer peripheral surface of the outer pipe 12, and a ring-shaped inner pipe keeping member 83 slidably provided between the abovementioned connecting rod 5*c* and tubular core metal 6, within the space between the abovementioned split fixing members 81, 82. The keeping member 83 is connected and held in the split fixing members 81, 82, by means of a connecting pin 84 integrally provided with the keeping member, through a slot 6*c* formed in the tubular core metal 6. The split fixing members 81, 82 is integrally fixed on the outer pipe 12 by being tightened with threaded bolts 85, 85 so as to clamp the outer pipe 12 between the fixing members.

In the above-described construction, when the bending die 1 is rotated, from its state as shown in FIG. 1(A), in an arrow direction as illustrated, together with the fixing die 2, the outer pipe 12 of the hollow double-structured pipe 10 is gradually drawn in this direction, whereby the forwarding member 8 fixed to the rear end part of the outer pipe 12 also moves to the side of the die 1 along with the outer pipe 12.

Along with this movement, the inner pipe 11 is also pushed in the same direction by the inner pipe keeping plate 83 of the abovementioned forwarding member 8 to be gradually forwarded to the side of the bending die 1, integrally with the outer pipe 12, whereby the inner and the outer pipes 11, 12 are bent into a predetermined form on and along the bending die 1, as shown in FIG. 2.

In this way, the present invention is of such a construction that, as mentioned in the foregoing, the front end part 6*a* of the tubular core metal 6 is caused to protrude forwardly of the abovementioned starting position L for bending, as shown in FIG. 3, and then the chamfered part 61, 62 is formed on this protruded part in the substantially same shape as that of the final bent shape of the inner and the outer pipe 11, 12; hence these inner and outer pipes 11, 12 can be favorably bent on and along their chamfered parts 61, 62.

In particular, the inside of the hollow double-structured pipe 10, in its bending direction (especially, the inside of the inner pipe 11 in its bending direction), tends to bring about creases, etc., due to action of force in the direction of shrinkage of the pipe at the time of its bending work. On account, however, of the fact that the chamfered part 61 having the substantially same shape as the final bent shape of the inner pipe 11 is formed on the inner peripheral surface of the front end part 6*a* of the tubular core metal 6 as mentioned above, the inner pipe 11 can be bent smoothly, without failure, along the curved surface of the chamfered part, whereby, even when the inner pipe of thin wall thickness is used, its bending work can be effected without such undesirable creases, etc. being brought about. Further, by providing the auxiliary core metal 51 on the forward end 5*a* of the inner core metal 5, as in the above-described embodiment, the inner pipe 11 can be prevented from its inward flexion or buckling, with higher possibility of effecting favorable bending work.

FIGS. 4 and 5 illustrate another embodiment of the hollow double-structured pipe bending apparatus according to the present invention, wherein a notch 6*d* is formed at least on one of the inside and the outside of the projected part 6*a* of the tubular core metal 6, in its bending direction, and a spacer member 63 for the inner and the outer pipes 11, 12 is provided in the notch 6*d*. In more detail, in the illustrated case, a substantially T-shaped notch 6*d* is formed in both the inside and the outside of the abovementioned protruded part 6*a*, in its bending direction, into each of the notch 6*d* of which there is fitted the spacer member 63 having the substantially same shape and size as those of the notch 6*d*.

The face 63*a* of the outside of each spacer member 63, in its bending direction, is formed in a substantially same shape as that of the inner and the outer pipe 11, 12 as at the end of their bending work, while the face 63*b* of the inside of each spacer member, in its bending direction, is formed in a substantially same shape of the cylindrical surface as that of the inner peripheral surface or outer peripheral surface of the tubular core metal 6. Also, the extreme end (i.e., the right end side as shown in FIG. 4) of each spacer member 63 is formed in a size substantially equal to the wall thickness of the tubular core metal 6 (i.e., substantially equal to the space gap between the inner pipe 11 and the outer pipe 12) or slightly smaller than the space gap. By the way, a curved surface 61, 62 same as that in the previous embodiment is formed on the protruded part 6*a* of the tubular core metal 6.

Figure 5A:
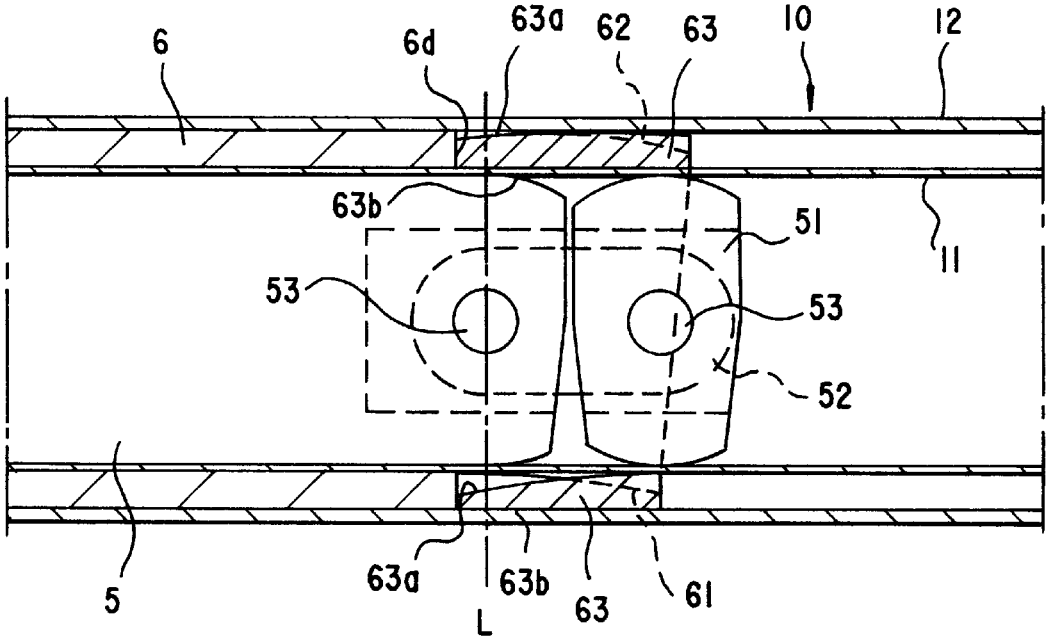
FIG. 5(A) is a front view, in an enlarged longitudinal cross-section, showing the main part of the pipe bending apparatus according to the present invention, in which use is made of the abovementioned tubular core metal.

As shown in FIG. 5(A), the abovementioned spacer member 63 is to be disposed and accommodated between the inner pipe 11 and the outer pipe 12, together with the tubular core metal 6, in its state of being disposed and accommodated within the abovementioned notch 6*d*, with the result that the spacer member will not fall apart in the diametral direction of the tubular core metal 6 by these inner and outer pipes 11, 12. Furthermore, since the spacer member 63 and the notch 6*d* are shaped in the form of a letter "T", there is no possibility of its being lagged in the axial direction.

Figure 5B:
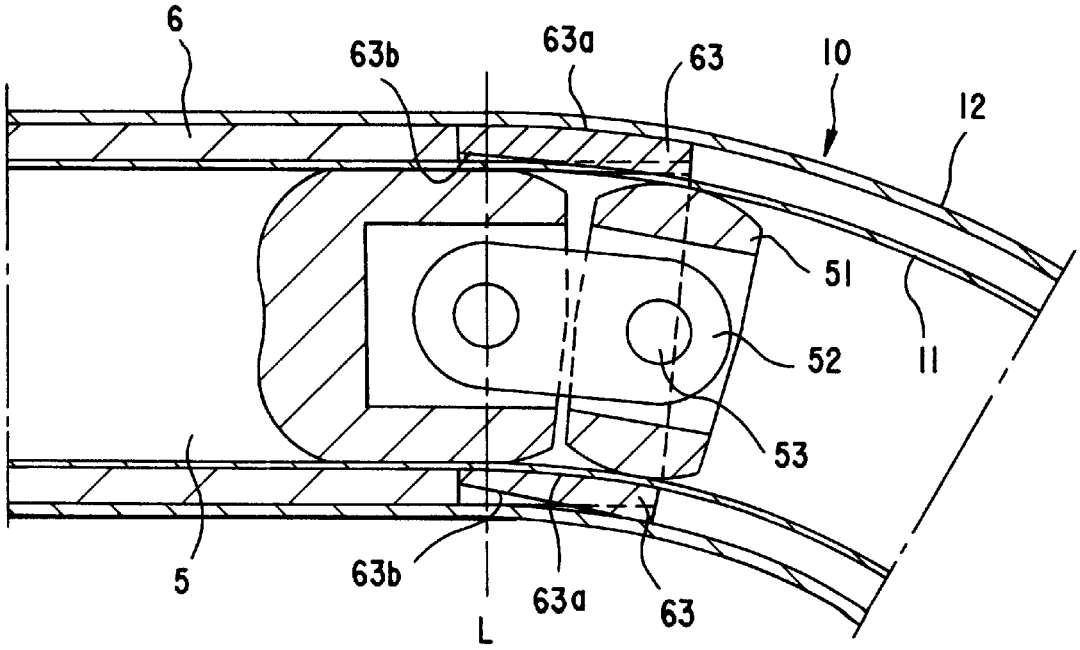
FIG. 5(B) is also a front view, in an enlarged longitudinal cross-section, showing the main part of the pipe bending apparatus according to the present invention, in its state of bending work.

As has been described in the foreoing, the inner pipe 11 and the outer pipe 12 are subjected to the bending work, as shown in FIG. 5(B), in a state of the spacer member 63 being disposed between the inner pipe 11 and the outer pipe 12, hence the bending work can be effected smoothly and sequentially by the help of the abovementioned each spacer member 63, in a state of the inner pipe 11 and the outer pipe 12 being kept at their constant space gap. In particular, when the auxiliary core metal 51 is provided at the extreme end of the inner core metal 5 as in the illustrated embodiment, it becomes possible to effect the bending work in a state of the auxiliary core metal 51 and the spacer member 63 being in a constant contact with both inner and outer surfaces of the inner pipe 11.

As the result, the bending work can be done favorably without creases, bucklings, etc. being caused, even if an inner pipe of thin wall thickness is used. By the way, in the above-described embodiment as shown n FIG. 5(B), the spacer member 63 is provided on both outside and inside of the tubular core metal 6 in its bending direction, although such spacer member may be disposed in either the inside or outside of the tubular core metal.

Figure 4A:
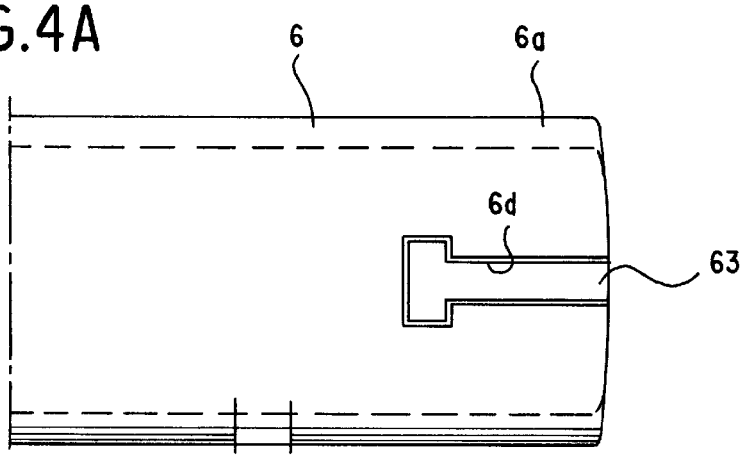
FIG. 4(A) is a plan view showing a modified embodiment of the tubular core metal.
Figure 4B:
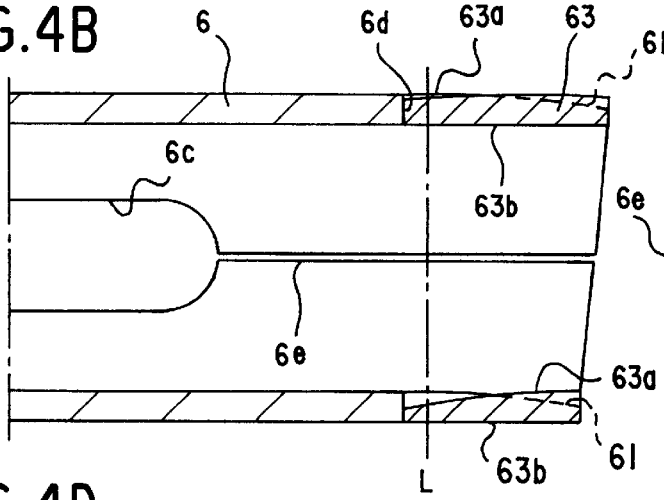
FIG. 4(B) is a front view, in longitudinal cross-section, of the tubular core metal.
Figure 4C:
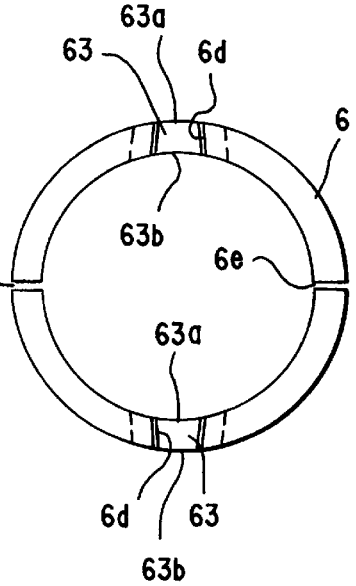
FIG. 4(C) is a side view of the tubular core metal.
Figure 4D:
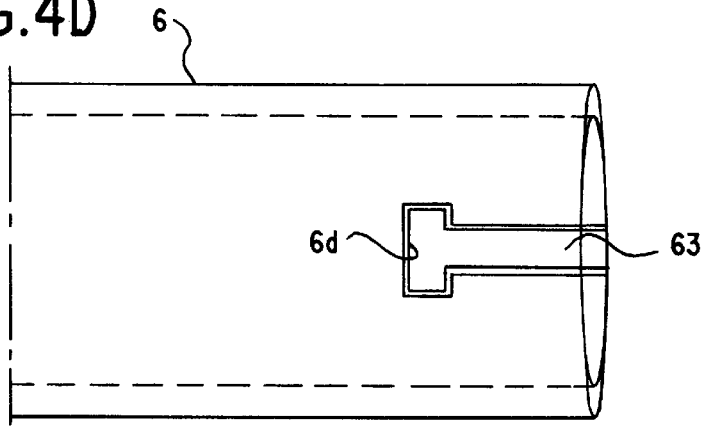
FIG. 4(D) is a bottom view of the tubular core metal.

It may also be feasible to incise a grove or slot, in both side surfaces of a direction vertical to the abovementioned bending direction of the extreme end of the abovementioned tubular core metal 6, a grooves 6*e* in and along the matrix direction of the tubular core metal 6, as shown in FIGS. 4(B) and 4(C). In so doing, the extreme end part of the tubular core metal 6 is permitted to perform its flexion at the time of the bending work, with the consequent possibility of rendering a clearance between the tubular core metal 6 and the inner pipe 11 to be minimum possible. This would contribute to improvement in the precision in the bending work, and to further prevention of undesirable creases and buckling from taking place. In the case of the illustrated embodiment as shown in FIG. 4(B), the abovementioned incised groove (or slot) 6*e* is made to be communicatively connected to the abovementioned slot 6*c*, although such incised groove may each be independent without its being communicatively connected.

In each of the above-described embodiments, a single auxiliary core metal 51 is provided on the extreme end of the inner core metal 5. However, as shown in FIG. 6(A), a plurality of auxiliary core metal 51*a* to 51*c* may be connected in series with use of connecting members 52*a*, 52*b*, etc. In so doing, slide-guide of the inner pipe 11 and the outer pipe 12 can be secured more smoothly at the time of the bending work. In this case, a stopper or the like may be provided between the adjacent auxiliary core metals or the connecting members, whereby the auxiliary core metals 51*a* to 51*c* may be positioned and held, as shown in FIG. 6(B) in their state of being bent along the predetermined bent form. In the drawing, a reference numeral 53 designates the connecting rod and a numeral 54 refers to a stopper screw for the connecting member 52*b* of the auxiliary core metal 51*c*.

As has been explained in the foregoing, since the hollow double-structured pipe bending apparatus according to the present invention is of such construction that, in a hollow double-structured pipe bending apparatus, wherein the inner core metal 5 is inserted into the inner pipe 11 of the hollow double-structured pipe 10, while a tubular core metal 6 is interposed in a space gap between the inner pipe 11 and the outer pipe 12, and these core metals are positioned in the vicinity of the starting position for the bending work, one end part of the abovementioned tubular core metal 6 is made to protrude forwardly of the bending direction with respect to the abovementioned starting position for bending, and a chamfered part is formed on the protruded part, in a substantially same shape as the final bent shape of the abovementioned inner pipe 11 and outer pipe 12. With the consequence that the inner pipe 11 and the outer pipe 12 can be bent smoothly and favorably on and along the chamfered part, hence, even in the case of an inner pipe of a thin wall thickness being used, there is no possibility of creases, etc. being brought about inside the inner pipe in its bending direction, hence favorable bending work can be effected.

Although, in the foregoing, the present invention has been described with reference to particular embodiments thereof, it should be understood by those persons skilled in the art that the invention is not limited to these specific embodiments alone, but it is capable of a variety of alternative embodiments within the spirit and scope of the invention as recited in the appended claims.

What is claimed is:

1. An apparatus for bending a hollow double-structured pipe having an inner pipe and an outer pipe, comprising:

an inner core metal which is insertable into the inner pipe;

an auxiliary core metal connected to an extreme end of said inner core metal in a bendable manner;

a tubular core metal which is insertable in a space gap between the inner pipe and the outer pipe; and bending dies for bending the hollow double-structured pipe, wherein both of said core metals are positioned at a starting position where said bending dies start to bend the hollow double-structured pipe, and one end part of said tubular core metal is positioned so as to protrude forwardly with respect to the starting position, wherein a chamfered part is formed on the protruded end part of said tubular core metal to have substantially the same shape as a final bent shape of the inner and outer pipes, and wherein a notched part is formed in at least one of an inside and an outside of the protruded end part with respect to a bending direction of the hollow double-structured pipe, and a spacer member is provided in the notched part in a movable manner in the bending direction so that said spacer member and said auxiliary core metal can be kept in contact with the outer and the inner surfaces of the inner pipe, respectively, and said spacer member can keep the space gap constant, when the double-structure pipe is bent by said bending dies.

2. The hollow double-structured pipe bending apparatus according to claim 1, wherein an outer face of said spacer member with respect to the bending direction is formed in a curved face of substantially the same shape as that of the final bent shape of the inner and outer pipes.

3. The hollow double-structured pipe bending apparatus according to claim 1 or 2, wherein grooves, each groove in the form of a slit, are incised along a matrix direction of said tubular core metal, at two places of at least the protruded end part with respect to a direction vertical to the bending direction.

4. The hollow double-structured pipe bending apparatus according to claim 1, wherein a plurality of said auxiliary core metal are provided at the extreme end part of said inner core metal.

5. The hollow double-structured pipe bending apparatus according to claim 4, wherein at least a contact surface of said auxiliary core metal with the inner pipe is formed in a spherical shape of substantially the same diameter as that of the inner pipe.

6. The hollow double-structured pipe bending apparatus according to claim 5, wherein said auxiliary core metal is positioned and held in its bent state along the final bent shape of the inner pipe at the time of the bending work of the inner and outer pipes.

* * * * *